US005228388A

United States Patent [19]

Brown

[11] Patent Number: 5,228,388

[45] Date of Patent: * Jul. 20, 1993

[54] SCORING OR PERFORATING BAR FOR OFFSET PRESSES

[76] Inventor: William R. Brown, 4815 W. 61st. Ter., Mission, Kans. 66205

[ * ] Notice: The portion of the term of this patent subsequent to Jun. 23, 2009 has been disclaimed.

[21] Appl. No.: 855,241

[22] Filed: Mar. 23, 1992

Related U.S. Application Data

[63] Continuation-in-part of Ser. No. 700,538, May 14, 1991, Pat. No. 5,123,347.

[51] Int. Cl.[5] ..... B41F 13/54

[52] U.S. Cl. ..... 101/226; 101/224

[58] Field of Search ..... 101/377, 76, 226, 224

[56] References Cited

U.S. PATENT DOCUMENTS

| | | | |
|---|---|---|---|
| 753,061 | 7/1904 | Gates . | |
| 1,607,388 | 11/1926 | Chisholm | 101/377 |
| 1,657,726 | 1/1928 | Streb et al. | 101/377 |
| 2,007,544 | 7/1935 | Meisel . | |
| 2,286,087 | 6/1942 | Hanigan | 101/377 |
| 2,469,526 | 5/1949 | Sloat . | |
| 2,832,411 | 4/1958 | Richards et al. . | |
| 2,842,202 | 7/1958 | Boyd . | |
| 3,554,070 | 1/1971 | Boyd . | |
| 4,596,546 | 6/1986 | Schellenberg . | |
| 4,676,159 | 6/1987 | Nawrath . | |
| 4,936,214 | 6/1990 | Overhalser . | |
| 4,962,686 | 10/1990 | Boyd et al. . | |
| 5,123,347 | 6/1992 | Brown | 101/226 |

*Primary Examiner*—Edgar S. Burr
*Assistant Examiner*—John S. Hilten
*Attorney, Agent, or Firm*—Wm. Bruce Day

[57] ABSTRACT

An improved score or perforator bar device is adapted for use with certain printing presses having a blanket cylinder revolving upon an axle shaft and with an elongate slot for attachment of the blanket. The adapter device includes a bar of a length substantially the same as the cylinder with a working side having a longitudinal slot for mounting a knife blade. The knife blade has either a scoring edge or a perforation edge, depending upon the desired effect. The bar has an attachment side for connection to the blanket cylinder and has legs extending generally perpendicularly. The legs have recessed ends for bearing against the cylinder shaft so that the force of the blade is transferred to the axle shaft and not to the cylinder shell. Hooks selectively extend about the cylinder shaft. A screw arrangement retains the bar in a cylinder slot. A numbering device in lieu of the knife blade can be retained within the longitudinal slot.

9 Claims, 6 Drawing Sheets

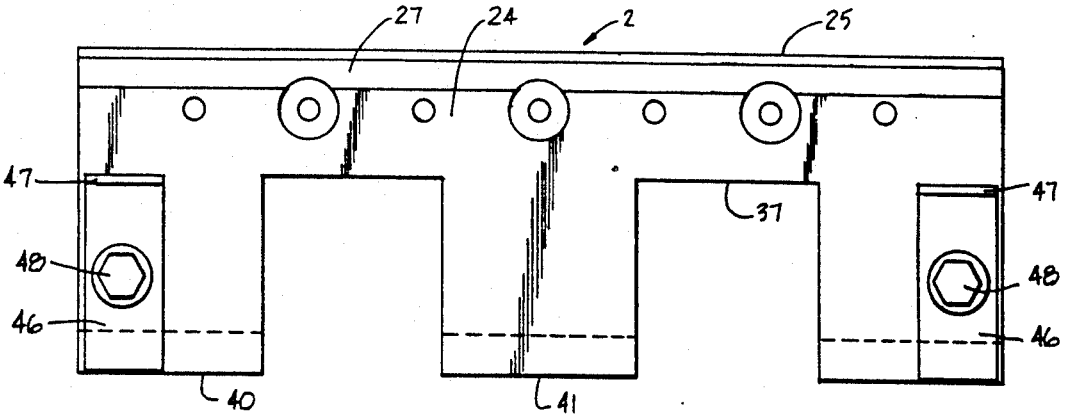
Fig. 5
Fig. 6
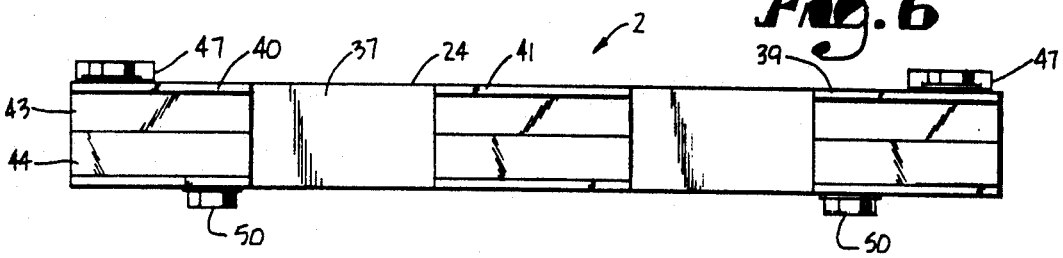
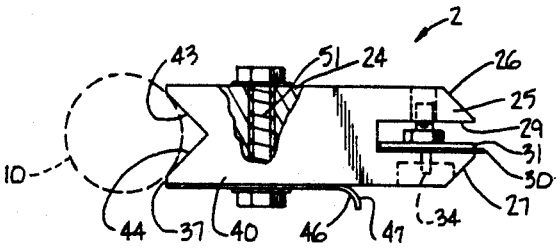
Fig. 7
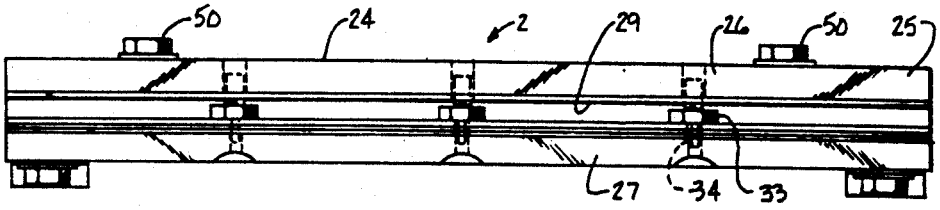
Fig. 8

SCORING OR PERFORATING BAR FOR OFFSET PRESSES

Related Patent

This application is a continuation-in-part of application Ser. No. 07/70,538, filed May 14, 1991, now U.S. Pat. No. 5,123,347, issued Jun. 23, 1992.

FIELD OF THE INVENTION

This invention relates to printing presses in general and in particular to a perforating and scoring blade for printing presses.

BACKGROUND OF THE INVENTION

Offset or lithographic printing presses have been in common use for many years. Indeed, the A.B. Dick printing presses, models 360 and 9800 series with chain delivery are perhaps the most common presses in use. These presses include an upper plate cylinder, a blanket cylinder and a lower impression cylinder. The blanket cylinder is a shell cylinder; that is, it is formed of an outer cylinder wall or shell with an inner central axle shaft. Radial lugs connect the shell to the inner shaft. The blanket cylinder is relatively expensive and the shell can be deformed upon excessive weight bearing or use. The present invention provides a perforated scoring adapter bar which readily and easily fits onto the blanket cylinder. Installation does not require disassembly of the printing press in any way and the job is inexpensively and easily accomplished. Moreover, the disclosed perforating and scoring adapter bar does not place undue stress or wear upon the blanket cylinder and all stresses are borne by the sturdy blanket cylinder axle shaft, rather than by the more easily damaged cylindrical shell.

OBJECTS OF THE INVENTION

The principal objects of the present invention are: to provide an improved adapter bar for a printing press which is capable of either scoring or perforating operations; to provide such an adapter bar which fits easily and readily within the longitudinal slot on a blanket cylinder; to provide such an adapter bar in which scoring and perforating forces are transferred to the sturdy axle shaft of the blanket cylinder; to provide such an adapter bar in which the perforating and scoring rules may be used over and over again until becoming too dull to do a satisfactory job; to provide such an adapter bar in which the press is always ready to receive the bar without any previous preparation such as removing blankets or replacing the blankets when finished; to provide an adapter bar to which a number device can be affixed; to provide an adaptor bar having hooks to affix it to the cylinder axle shaft; to provide such an adapter bar which can be installed and replaced within a few minutes; and to provide such an adapter bar which is easy to use, economical and readily replaced.

Other objects and advantages of this invention will become apparent after considering the following disclosure.

DESCRIPTION OF THE DRAWINGS

FIG. 5 is a bottom plan view of the adapter bar.

FIG. 6 is a rear elevational view of the adapter bar.

FIG. 7 is a side elevational view of the adapter bar.

FIG. 8 is a front elevational view of the adapter bar.

DESCRIPTION OF THE PREFERRED AND ALTERNATE EMBODIMENTS

As required, detailed embodiments of the present invention are disclosed herein. It is, however, to be understood that the disclosed embodiments are merely illustrative of the invention, which may be embodied in various forms. Therefore, specific structural and functional details disclosed herein are not to be interpreted as limiting, but merely as providing the proper basis for the claims and as a representative basis for teaching one skilled in the art to employ the scoring or perforating bar for offset presses in virtually any appropriately specific and detailed structure.

Figure 1:
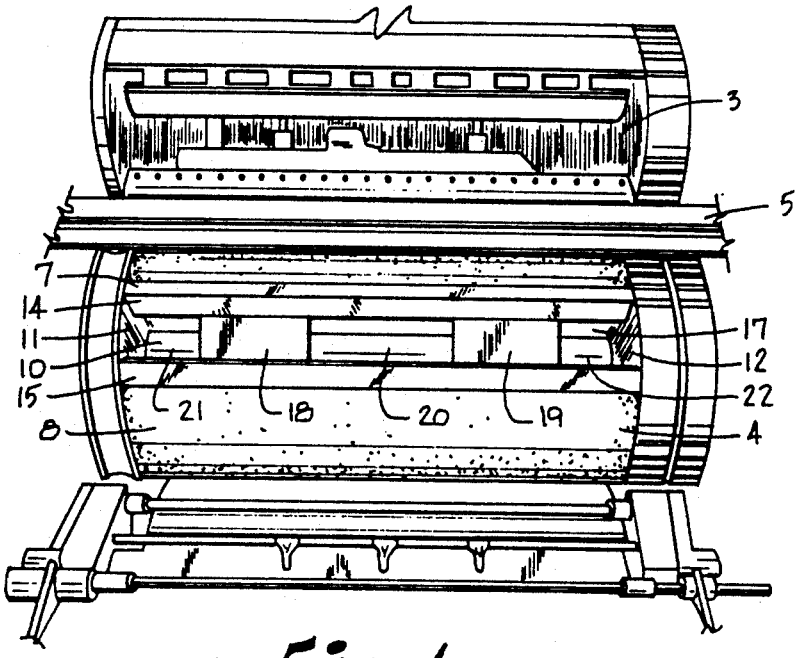
FIG. 1 is a front elevational view of a printing press shown ready to receive the adapter bar of the present invention.

FIG. 1, numeral 1 is directed to an offset or lithographic printing press and in particular, depicts an A. B. Dick printing press Model 360.

Figure 2:
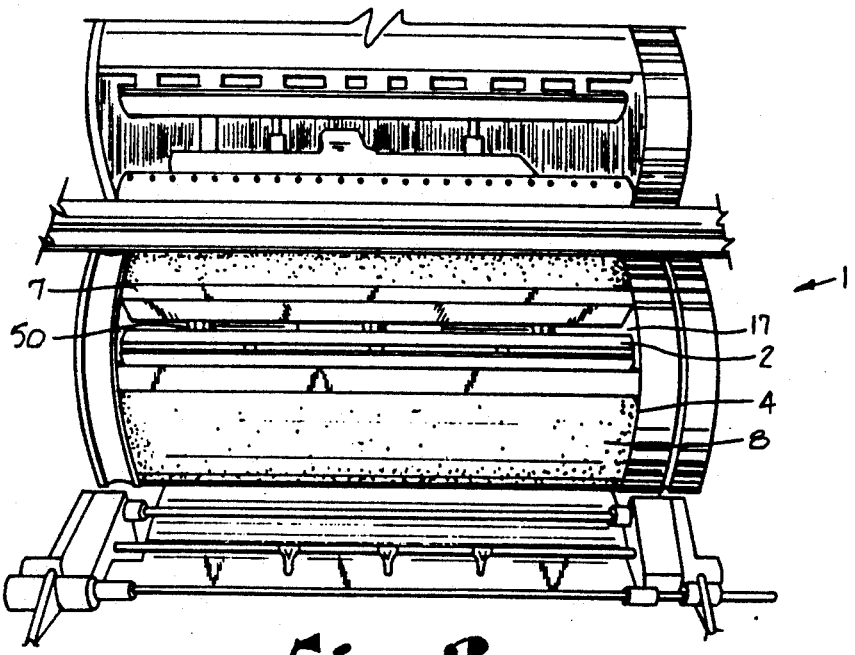
FIG. 2 is an elevational view of a printing press with an adapter bar of the present invention installed.
Figure 3:
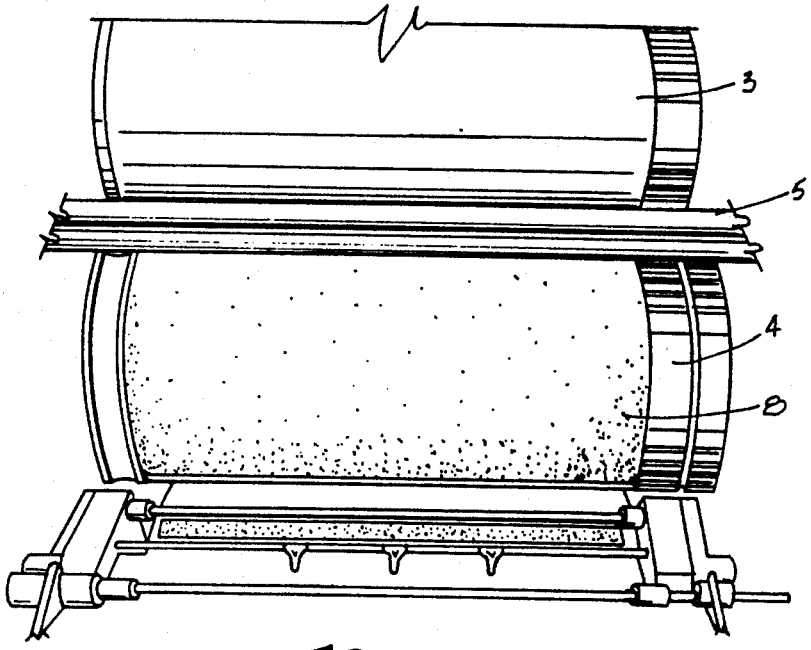
FIG. 3 is an elevational view of a printing press in similar rotational view.
Figure 4:
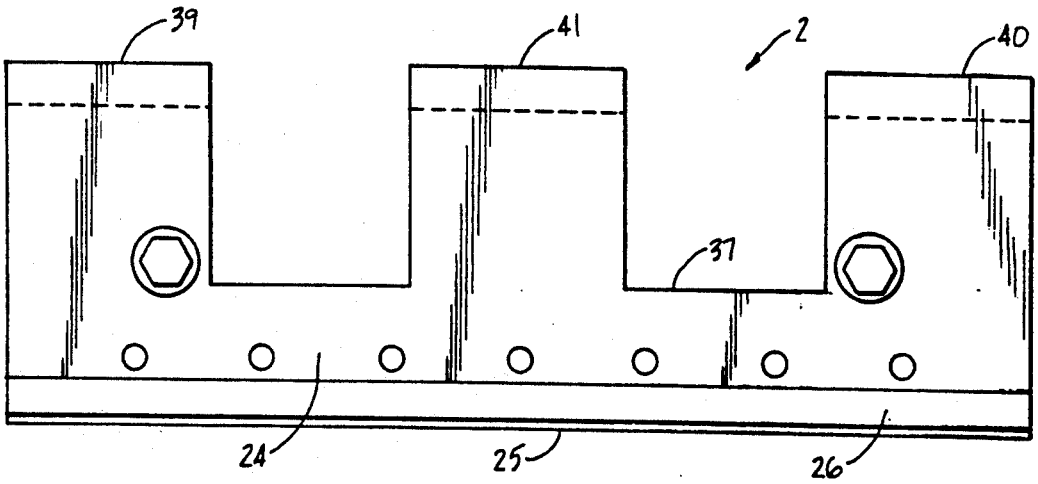
FIG. 4 is a plan view showing the adapter bar of the present invention.

FIG. 2 discloses the printing press 1 with a scoring or perforating bar device 2 comprising the present invention mounted therein. The bar device 2 is particularly adapted for use on A.B. Dick printing presses, models 360 and 9800 series with a chain delivery, although the concept of the invention could be utilized with numerous other press configurations.

Referring to FIG. 1, the press includes an upper plate cylinder 3, a blanket cylinder 4, both supported within the press by a framework 5, and a lower impression cylinder (not shown).

The blanket cylinder 4 is a hollow or shell cylinder, having an outer front of a shell 7, about which a blanket 8 is affixed. The blanket cylinder 4 rotates upon a central axle shaft 10 and has opposite end walls 11 and 12. Attached to and extending downwardly or inwardly from the shell 7 are edge bars 14 and 15 which are parallel and form a space or blanket cylinder gap 17 therebetween for purposes hereinafter described The edge bars 14 and 15 respectively abut the shell 7 over which the blanket 8 is mounted. Webs 18 and 19 extend radially into the blanket cylinder 4 and support the shell 7 relative to the axle shaft 10. In the illustrated example, the webs 18 and 19 are spaced and form a center space 20 and opposite end spaces 21 and 22 adjacent the end walls of 11 and 12.

Referring to FIG. 2, the bar device 2 fits within the blanket cylinder gap 17.

The bar device 2 is shown in more detail with respect to FIGS. 4 through 8, and generally includes an elongate bar 24 of a length substantially the same as the blanket cylinder 4 to which the bar 24 is to be affixed. The bar 24 has a working side 25 with beveled edges 26 and 27. Working side 25 has a longitudinal slot 29 extending its length, in which may be mounted blades or rules, such as a scoring or a perforation blade 30. To contain the blade 30 within the slot 29, a backing strip or spacer 31 is positioned parallel and against the blade 30 and the blade 30 and spacer 31 pinched against a wall of the slot 29 by a headed screw 33. Preferably, the headed screw 33 includes a short, axially extending nub 34 which extends through a hole 35 in the blade 30, FIG. 11, and helps insure that the blade 30 does not inadvertently become loose from the blade retaining slot 29. In the illustrated example, there are screws maintaining the blade 30 within the slot 9.

The bar device 2 also has an attachment side 37 including a plurality of legs, such as opposite end legs 39 and 40 and middle leg 41 which extend generally perpendicularly to the longitudinal axis of the bar 24. The legs 39, 40 and 41 have ends with recesses, such formed by beveled faces 43 and 44 for resting upon and cradling the axle shaft 10. The legs 39, 40 and 41 are spaced so as to straddle the webs 18 and 19 within the blanket cylinder 4.

In the example shown in FIG. 7, a clip 46 with outwardly projecting fingers 47 is fixed to each of the end legs 39 and 40 and is designed to rest against the underside of the shell 7 when the bar device 2 is positioned within the blanket cylinder gap 17. The clips 46 are preferably of springy material for ease of construction and are affixed to the bar 24 as by bolts 48.

The bar device 2 is held within the blanket cylinder gap 17 by wedging, that is, the bar 24 has two headed bolts 50 received in threaded bores and which can be backed out of the bores so that the bolt heads engage the opposite wall of the blanket cylinder gap 17, as shown in FIG. 2. The coil springs 51 bias the bolt to an outward position. This wedging effect enables the bar device 2 to be mounted within the gap 17 without using bolt or screw holes in the cylinder gap walls which can wear out or become loose with use.

Figure 9:
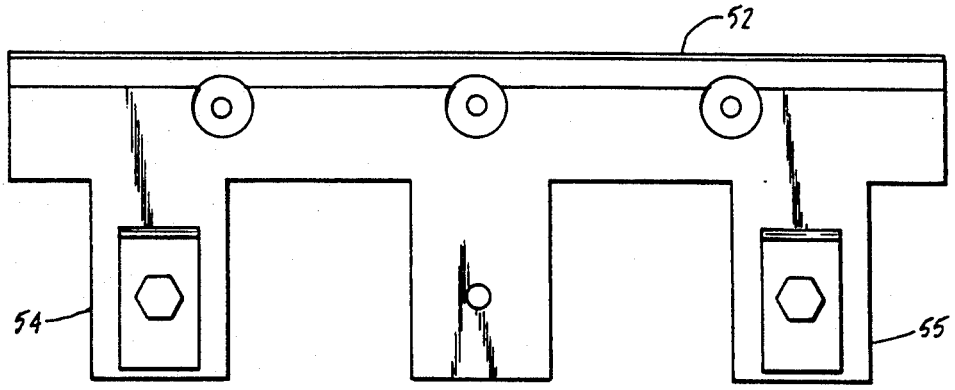
FIG. 9 is a top plan view of an alternative embodiment of the adapter bar.

The bar device 2 can be readily adapted for use with different configurations of blanket cylinders. For example, in FIG. 9 is shown a bar device 52 which is substantially identical in configuration to the bar device 2 with the exception that the end legs 54 and 55 are not positioned all the way at the opposite ends of the bar 24, as is shown in connection with FIGS. 5 through 8, but are instead inset a slight amount such to conform to a different configuration of blanket cylinder gap.

Figure 10:
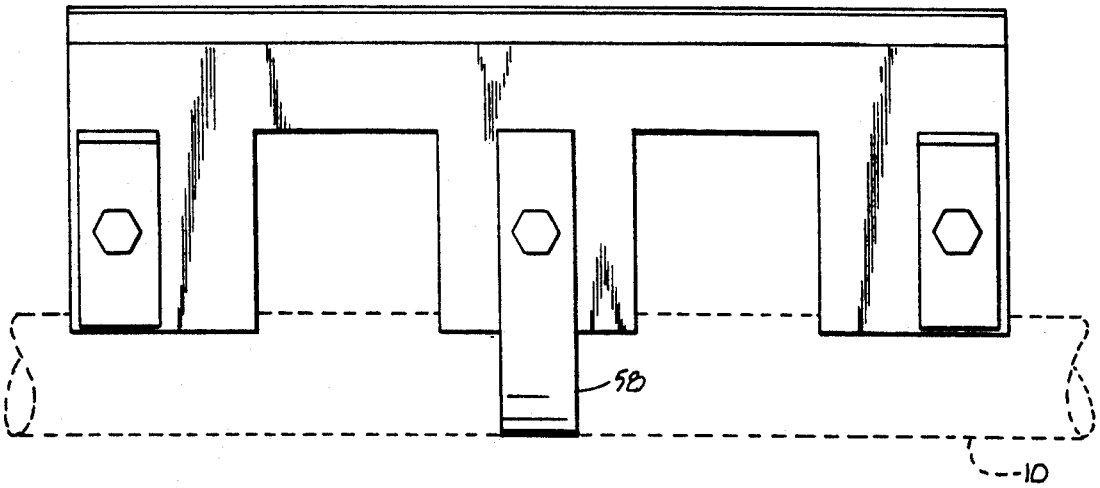
FIG. 10 is a second front elevational view of an embodiment of the adapter bar.

In FIG. 10 is shown a connector clip 58 which can be used in connection with either of the configurations shown in FIG. 5 through 8 or FIG. 9. The connector clip 58 is a spaced, resilient spring clip with opposed arcuate fingers which resiliently clip about the axle shaft 10 when the bar device 2 is mounted within the blanket cylinder gap 17. In some installations, the connector clip 58 may be helpful in retaining the bar device 2 in a proper position connected to the axle shaft 10.

Figure 11:
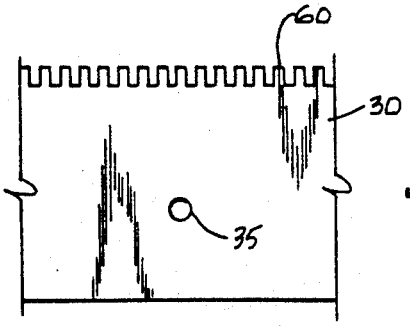
FIG. 11 is a fragmentary view showing a form of a blade which may be emplaced within the adapter bar.

In FIG. 11 is shown a blade 30 having an edge 60, particularly adapted for creating a perforation line in a web of printed paper material moving between the blanket cylinder 4 and the lower impression cylinder (not shown). It will be appreciated that to make a scoreline, the blade edge 60 would be a smooth edge.

The bar device 2 is fast and easy to install and is simply inserted through the blanket cylinder gap 17 until the recesses on the leg ends fix firmly upon the axle shaft 10. The mounting clips 46 may include elongate bolt holed slots so that upon loosening and tightening the bolts 48, the clips 46 can be adjusted upwardly and downwardly to stabilize the bar device 2 within the gap 17 and to properly position the bar 2 relative to the edge of the blanket cylinder shell 7. The headed bolts 50 are rotated outwardly to press against the opposite wall of the gap 17. The bar device 2 is thereby installed in the gap 17 and is ready to provide a straight and effective score and perforation device. No removal of blankets is necessary or even desirable in order to fit the bar device 2 into the blanket cylinder gap 17. Moreover, any impact caused by printing is directed through the bar device 2 through the axle shaft 10 and not to the cylinder shell 7. The force of the perforation or score is thus absorbed by the strongest part of the blanket cylinder 4 and preserves the shell 7 from any deformation or weakening.

Blades 30 with different score or perforation edges may be used over and over again, since they are not attached by adhesive or otherwise semi-permanently affixed within the bar device slot 29. Removal and replacement of the blade 30 within the slot 29 is easily and quickly accomplished by backing out and re-tightening of the screws 33. Removal and replacement of the blades 30 can be accomplished without the removal of the bar device 2 from an installed position in the blanket cylinder gap 17.

The reference numeral 75, FIGS. 12 through 15, is directed to an improved adaptor bar embodying the present invention. The improved adaptor bar 75 is mounted upon the axle shaft 10 by a hook means 77 which tends to be more secure than the clip 46 and is easier to manipulate so that the adaptor bar 75 may be readily removed and replaced as desired.

Figure 12:
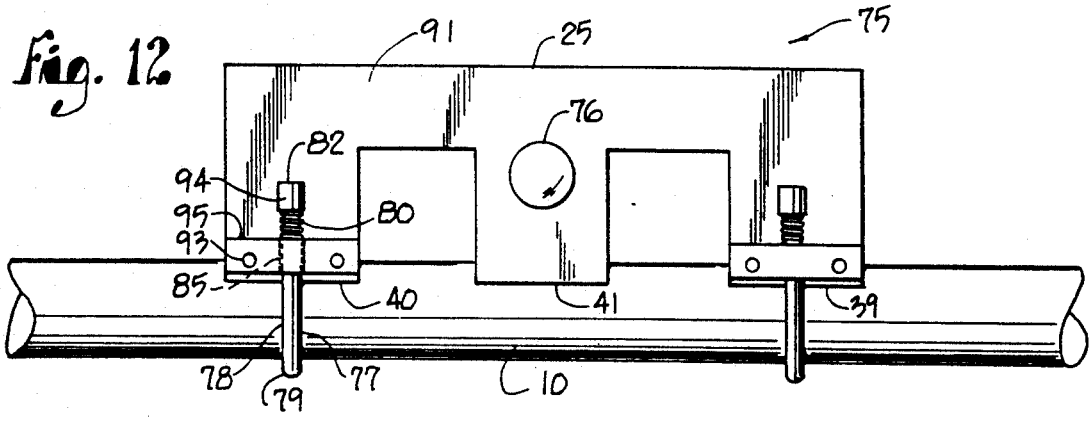
FIG. 12 is a front elevational view of an improved adaptor bar mounted upon a cylinder axle shaft.

Referring to FIG. 12, the adaptor bar 75 contains two hook means 77 that in the illustrated example are comprised of cylindrical stock having a first straight leg 78 and a curved hook portion 79. The leg 78 extends through a smooth bore 85 in an attachment bar 95 which is affixed to a lower portion of the respective legs 39 and 40 by screws 93. To manipulate the hook means 77, an upper end 94 at the terminus of the first leg 78 has an expanded screw head 82 with a coil spring 80 positioned between the head 82 and the attachment bar 95. To swing the hook portion 79 into and out of gripping engagement with the axle shaft 10, the worker inserts a screwdriver tip into the screw head 82, presses downwardly to overcome the spring force and twists. Twisting in a first direction causes the hook portion to swing under the shaft 10 and in a second direction, to swing out from under the shaft 10. In the engaged position, the spring 80 maintains the hook portion 79 in gripping engagement. When the hook portion 79 is swung out of engagement, the adaptor bar 75 may be easily grabbed by finger pressure and removed.

Figure 13:
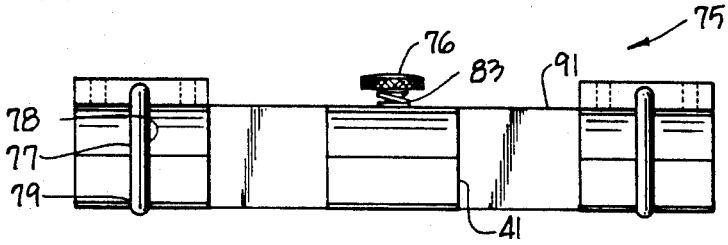
FIG. 13 is a bottom plan view of the improved adaptor bar.

Referring to FIG. 13, the improved adaptor bar 75 also includes a thumbscrew 76 spring biased to an outward position by a coil spring 83, that extends perpendicular from a front side 91 of the adaptor bar 75. The thumbscrew 76 and the coil spring 83 extend generally perpendicularly to the vertical axis of the middle leg 41. The coil spring 83 biases the thumbscrew 76 to an outward position. Loosening the thumbscrew 76 wedges the adaptor bar 75 within the blanket cylinder gap 17. Preferably, the thumbscrew 76 is of the flat type and has a knurled circumference.

Figure 14:
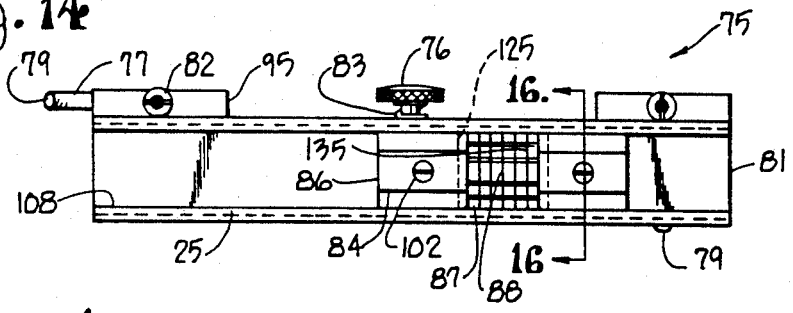
FIG. 14 is a top plan view of the improved adaptor bar showing a numbering machine within a top longitudinal groove.
Figure 15:
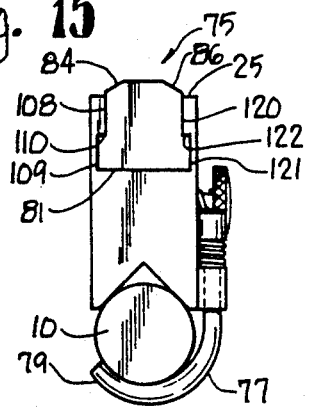
FIG. 15 is an end elevational view of the improved adaptor bar.

Referring to FIG. 14 and FIG. 15, the adaptor bar 75 further includes a top longitudinal groove 81 which may be narrow as shown in FIG. 8 to accommodate a scoring or perforation knife blade or may be wide, as shown in FIG. 14, to accommodate an indicia means 86. The indicia means 86 in the preferred embodiment comprises a numbering machine 87. The top longitudinal groove 81 is located on the working side 25 of the adaptor bar 75 and includes an upper longitudinal side 108 and a lower longitudinal side 109. The numbering machine 87 is positioned within the top longitudinal groove 81.

Referring to FIG. 15, an end elevational view of the improved adaptor bar 75 is presented. A side holder block 84 is illustrated and positioned within the top longitudinal groove 81. The upper longitudinal side 108 extends outward further than the lower longitudinal side 109, thereby creating a longitudinal shelf 110 on both sides of the top longitudinal groove 81. The longitudinal shelf 110 helps maintain the side holders 84 within the longitudinal groove 81.

Referring to FIGS. 14 through 17, the numbering machine 87 is maintained in a selected position by two side holders 84, one on each side of the numbering machine 87 and with each having upper overhanging tabs 125 that bear down upon and hold a conventional numbering device 88. The numbering device 88 includes a plurality of number indicia 135 mounted on rotatable wheels. The side holder 84 further includes an upper section 120, an outwardly extending lower section 121, a slot head screw 102, two ball bearings 103 and two springs 104. The numbering machine 87 is held in place within the top longitudinal groove 81 by turning the two slot head screws 102 to compress the two springs 104 and bias the ball bearings 103 to an outward position. This wedging effect enables the numbering machine 87 to be securely positioned within the top longitudinal groove 81.

Figure 16:
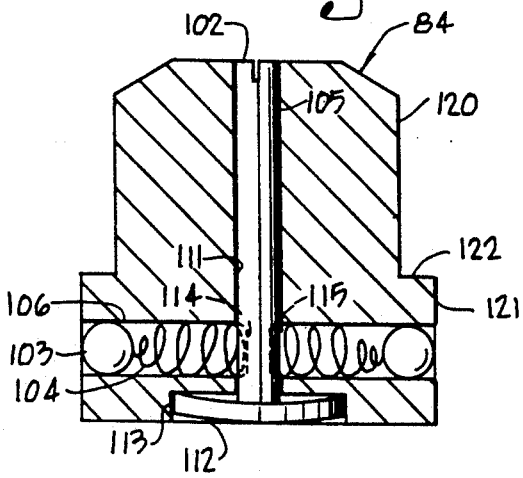
FIG. 16 is a cross sectional view of the numbering machine side holder taken along lines 16—16 of FIG. 14.

FIG. 16 presents a cross-sectional view of the numbering machine side holder 84 taken along lines 16—16 of FIG. 14. The side holder 84 includes a barrel 105 and a ball bearing spring chamber 106. The slot head screw 102 is positioned inside the barrel 105. The springs 104 and ball bearings 103 are located within the ball bearing spring chamber 106. The slot head screw 102 has a flat rotating bottom end 112 riding in an indented chamber 113. To secure the side holder 84 within the longitudinal grove 81, a lower end 111 of the slot head screw 102 has a cam section 115 with lobes 114 that rotate inside the barrel 105 as the slot head screw 102 is turned. The rotating of the slot head screw 102 positions the lobes 114 to make contact with and compress the springs 104. The compression of the springs 104 bias the ball bearings 103 to an outward position creating a wedging effect between the side holder 84 and the longitudinal groove 81. When the slot head screw 102 is rotated further the lobes 114 move away from the springs 104. This movement decompresses the spring 104 and unbiases the ball bearings 103 to an inward position, allowing the side holder 84 to be easily slide along the longitudinal groove 81.

Figure 19:
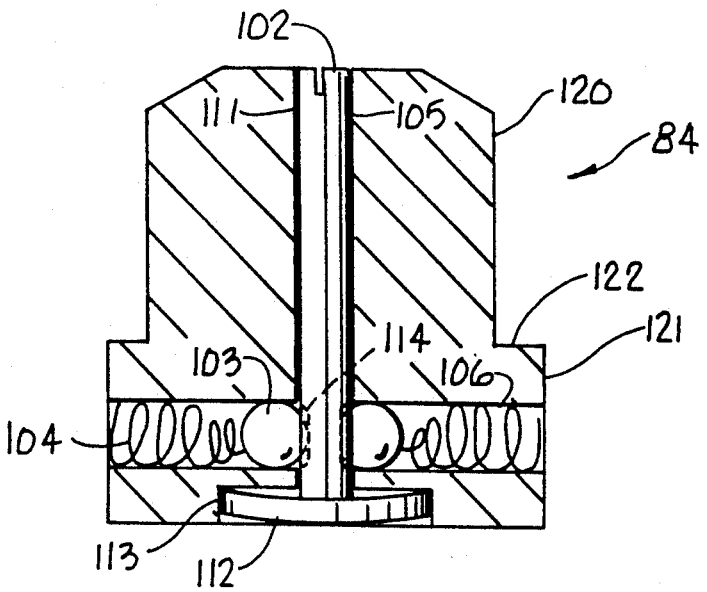
FIG. 19 is the same view as that of FIG. 16 but with a reversed arrangement of certain parts.

The arrangement of the springs 104 and ball bearings 103 are reversed in the embodiment shown in FIG. 19. This is the preferred configuration.

Figure 17:
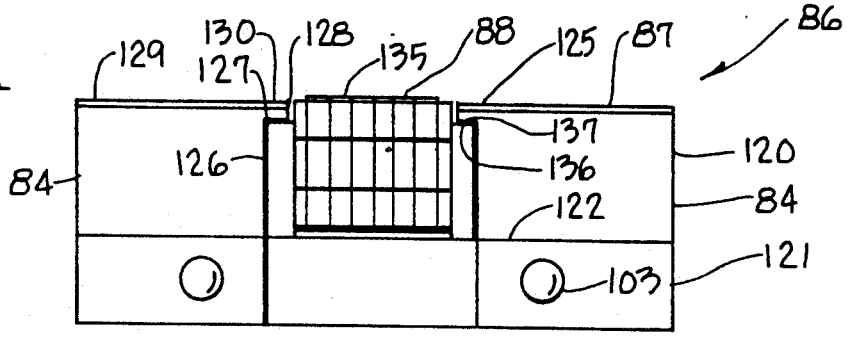
FIG. 17 is an enlarged front elevational view of the numbering machine.

FIG. 17 discloses the numbering machine 87 with the two side holders 84 and a conventional numbering device 88 located in the center. The side holders 84 have a lower working side 121 and a upper working side 120. The lower working side 121 extends outward to a greater position than the upper working side 120 thereby creating an edge 122. Therefore, when the side holder 84 is positioned within the top longitudinal groove 81, as illustrated in FIG. 15, the upper working side 120 is located adjacent to the upper longitudinal side 108 and the lower working side 121 is adjacent to the lower longitudinal side 109. The edge 122 is located adjacent to and under the longitudinal shelf 110 and together prevent the side holders 84 from being displaced vertically out of the longitudinal groove 81.

The side holders 84 also have a top surface 129 and an inner working side 126. Inner working side 126 has an upper hanging tab 125 extending its length that includes a bottom side 127 and facing side 128. The top surface 129 incorporates the top side 130 of the upper hanging tab 125.

The upper hanging tab 125 secures the numbering device 88 to the adaptor bar 75. The numbering device 88 includes a plurality of number indicia 135, mounted and centered upon rotatable wheels, that extends generally perpendicular to the longitudinal axis of the adaptor bar 75. Further, the plurality of number indicia 135 extends vertically outward beyond the sides 136 of the numbering device 88. The sides 136 axially extend to create a top surface 137 of a length substantially the same as the upper hanging tabs 125. The upper hanging tabs 125 are positioned over the top surface 137 and bear down upon and securely hold the numbering device 88 in place. This is because as the side holders 84 are securely held within the longitudinal groove 81, the numbering device 88 is simultaneously held in place.

Figure 18:
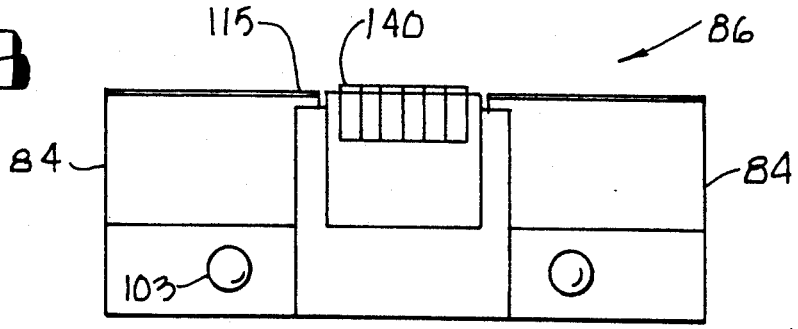
FIG. 18 is an enlarged front elevational view of the improved adaptor bar with a printing plate installed.

FIG. 18 discloses that the improved adaptor bar 75 can be modified so that the means indicia 86 can include a printing plate 140 in place of the numbering device 88. The printing plate 140 would be held in place by the side holders 84 and allow the improved adapter bar 75 to form letters on a paper web passing through the press.

Further, it is to be understood that while certain forms of this invention have been illustrated and described, the invention is not limited thereto, except insofar as such limitations are included in the following claims.

What is claimed and desired to be secured by Letters Patent is as follows:

1. A bar device which can be affixed to the blanket cylinder of an offset or lithographic press or the like for impressing upon a paper web passing through the press and wherein the cylinder has a central axle shaft and an elongate slot for attachment of a blanket, the device comprising:

a) an elongate bar having a length substantially the same as the blanket cylinder to which the bar is to be affixed;

b) said bar having a working side with a longitudinal groove for positioning and securing a means for impressing upon a paper web passing through said press;

c) said bar having an attachment side with legs extending generally perpendicular therefrom, said legs having ends for baring against said cylinder shaft when affixed to said blanket cylinder;

d) said bar having a front side with means for wedging said bar in said elongate slot of said cylinder when affixed to said blanket cylinder; and e) hook means having a rotatable and extensible shaft and a lower hook portion engageable about said cylinder shaft for retaining said bar in said elongate slot of said cylinder when affixed to said blanket cylinder.

2. The bar device set forth in claim 1 wherein said ends of said legs include a recess for cradling and receiving said shaft.

3. The bar device set forth in claim 1 wherein said hook means protrude from said ends of said legs and said lower hook portion extends about said shaft.

4. The bar device set forth in claim 1 wherein said means for wedging said bar includes a spring biased thumbscrew extendable to wedge said bar in said slot.

5. The bar device set forth in claim 1 wherein said means for impressing include an indicia means for printing and having side holders and a numbering device, wherein said side holders has a slot head screw and spring biased ball bearings extendable to wedge said side holders in said longitudinal groove, and said numbering device is positioned between and secured in place by said side holders.

6. The bar device set forth in claim 1 wherein said means for impressing include indicia means, include a printing plate positioned between opposite side holders, said side holders having a slot head screw and spring biased ball bearings extendable to wedge said side holders in said longitudinal groove, and said printing plate being positioned between and securely held in place by said side holders.

7. The bar device set forth in claim 1 wherein said hook means shaft has a coil spring therewith biasing said lower hook portion to an engagement position about said cylinder shaft.

8. A bar device which can be affixed to the blanket cylinder of an offset or lithographic press or the like for impressing upon a paper web passing through the press and wherein the cylinder has a central axle shaft and an elongate slot for attachment of a blanket, the device comprising:

a) an elongate bar having a length substantially the same as the blanket cylinder to which the bar is to be affixed;

b) said bar having a working side with a longitudinal groove for positioning and securing a means for impressing upon a paper web passing through said press;

c) said bar having an attachment side with legs extending generally perpendicular therefrom, said legs having ends for bearing against said cylinder shaft when affixed to said blanket cylinders;

d) said bar having a front side with means for wedging said bar in said elongate slot of said cylinder when affixed to said blanket cylinder; and e) hook means retaining said bar in said elongate slot of said cylinder when affixed to said blanket cylinder;

f) said means for impressing include an indicia means for printing and having side holders and a numbering device, wherein said side holders have a slot head screw and spring biased ball bearings extendable to wedge said side holders in said longitudinal groove, and said numbering device is

9. A bar device which can be affixed to the blanket cylinder of an offset or lithographic press or the like for impressing upon a paper web passing through the press and wherein the cylinder has a central axle shaft and an elongate slot for attachment of a blanket, the device comprising:

a) an elongate bar having a length substantially the same as the blanket cylinder to which the bar is to be affixed;

b) said bar having a working side with a longitudinal groove for positioning and securing a means for impressing upon a paper web passing through said press;

c) said bar having an attachment side with legs extending generally perpendicular therefrom, said legs having ends for bearing against said cylinder shaft when affixed to said blanket cylinder;

d) said bar having a front side with means for wedging said bar in said elongate slot of said cylinder when affixed to said blanket cylinder; and e) hook means retaining said bar in said elongate slot of said cylinder when affixed to said blanket cylinder.

* * * * *